United States Patent [19]

Walls et al.

[11] Patent Number: 4,880,555

[45] Date of Patent: Nov. 14, 1989

[54] ENZYME HYDROLYZED MALTODEXTRIN CONTAINING FINISHER/PRESERVER/CLEANER COMPOSITION FOR LITHOGRAPHIC PRINTING PLATES

[75] Inventors: John E. Walls, Hampton; Major S. Dhillon, Belle Mead, both of N.J.

[73] Assignee: Hoechst Celanese Corporation, Somerville, N.J.

[21] Appl. No.: 244,924

[22] Filed: Sep. 15, 1988

[51] Int. Cl.[4] ..... B41F 35/00; C11D 3/22; C11D 3/30; C11D 3/44

[52] U.S. Cl. ..... 252/143; 252/106; 252/136; 252/142; 252/153; 252/174.17; 252/174.18; 252/174.19; 252/174.21; 252/545; 252/548; 252/550; 252/DIG. 14; 536/103; 101/424

[58] Field of Search ..... 252/142, 545, 548, 550, 252/174.17, 174.18, DIG. 14, 143, 136, 106, 174.19, 174.21; 101/424; 536/103

[56] References Cited

U.S. PATENT DOCUMENTS

| | | | |
|---|---|---|---|
| 4,162,920 | 7/1979 | Gillich | 106/14.5 |
| 4,213,887 | 7/1980 | Walls et al. | 260/29.6 |
| 4,308,340 | 12/1981 | Walls | 430/331 |
| 4,349,391 | 9/1982 | Schell | 148/6.15 R |
| 4,504,406 | 3/1985 | Dhillon | 252/143 |
| 4,530,897 | 7/1985 | Berghaeuser et al. | 430/302 |

*Primary Examiner*—Paul Lieberman
*Assistant Examiner*—Susan Franklin
*Attorney, Agent, or Firm*—Richard S. Roberts

[57] ABSTRACT

A composition for finishing, preserving and cleaning lithographic printing plates composed of a polyol having a molecular weight in the range of from about 50 to about 2,000; a maltodextrin obtained by the enzyme hydrolysis of corn or potato starch, a mixture of a $C_{18}$ to $C_{30}$ alcohol and an aminated, aliphatic $C_8$ to $C_{24}$ alcohol sulfate with a ratio of alcohol to sulfate ranging from about 1:1 to about 5:1; and a composition of hydrocarbons having a boiling point in the range of from about 175° F. to about 500° F., and a flash point of above about 100° F., preferably containing 100% aliphatic components; and a substituted phenoxypoly(oxyethylene)ethanol having a hydrophile/lipophile balance of from about 8 to about 15; and a mono-, di- or triethanolamine; and water; and an acid to impart a pH to the composition of from about 2.5 to about 6.5; and a buffer to maintain the pH, and preferably a bacteriostat/fungistat component.

20 Claims, No Drawings

ENZYME HYDROLYZED MALTODEXTRIN CONTAINING FINISHER/PRESERVER/CLEANER COMPOSITION FOR LITHOGRAPHIC PRINTING PLATES

BACKGROUND OF THE INVENTION

The present invention relates to a composition suitable for finishing, preserving and cleaning lithographic printing plates which have been imagewise exposed and developed. The art of lithographic printing depends on the immiscibility of greasy ink and water, upon the preferential retention of a greasy ink by an image area of a printing plate and upon a similar retention of an aqueous dampening fluid by a non-image area. When a greasy ink is imprinted on a suitable surface and the entire surface is then moistened by an aqueous solution, the image area will repel the water and the non-image area will retain the water. Upon subsequent application of greasy ink, the image portion retains the ink and the moistened non-image area repels it. The ink on the image area is then transferred to the surface of the material on which the image is to be reproduced, such as paper, via an offset blanket, which provides better image quality. The most common type of lithographic plate to which the present invention is directed has a coating of a light sensitive substance that is adherent to an aluminum base sheet. Depending on the nature of the photosensitive coating employed, the plate may be positive or negative working. In both cases, the image area is oleophilic and the non-image areas are hydrophilic. Exposure is effected through a transparent mask, wherein the light sensitive layer, in the negative working case, hardens and becomes insoluble in a developinq solution. When the developer is applied to the plate, the non-image areas are removed. The remaining areas become the portions which attract greasy ink and are called the image areas. The surface underlying the areas from which the light sensitive coating have been removed are hydrophilic, do not attract greasy ink and are called the non-image areas.

It is known in the art that after repeated use of the plate and ageing of the surface, that the non-image areas are less able to repel ink and may tend to retain some of this ink. This is called scumming. Therefore, if the surface properties between the image and non-image areas are disturbed, for example, if the hydrophilic property of the non-image areas is deteriorated for some reason, inks are likely to adhere to such areas with deteriorated hydrophilicity and cause background stains. Such background stains are formed under a variety of conditions, for example where a lithographic printing plate is subjected to a burning-in treatment for the purpose of increasing length of run, or in the case where the surface of a plate is allowed to stand in the air without protecting it with a desensitizing gum. It is usual in the art that lithographic printing plates which are ready for printing must be subjected to such a protective finishing treatment before they are stored for prolonged periods of time. As a typical treating solution a gum arabic solution is very widely used. Dextrin and polyvinyl alcohol solutions are also known. U.S. Pat. No. 4,033,919 teaches a combination of polymers of acrylamide containing carboxy groups with acids as desensitizing agents for plates. After treatment with a desensitizing solution, printing plates are usually stored for some time. It has been found that the oleophilic character, i.e. ink receptivity of the image areas of the plate is often considerably reduced upon storage, so that a large amount of paper is wasted on roll-up. Of course, in prolonged storage of desensitized plates, undesired reactions may also occur between the desensitizing material and the surface of the support, and as a result, the hydrophilic properties of the plate are impaired. Therefore, a good finisher/preserver must function to desensitize the non-image areas to assure that they will not accept greasy ink upon printing, and prevent blinding in the image areas. It must also prevent oxidation of the background areas of the plate during storage or while waiting for press mounting. It must also be quickly removable from the plate so that it will not cause production delays. Typically a finisher must be quickly removable by a water rinse or most preferably must be removable by the fountain solution on the press. Quick roll-up is then essential in order to prevent paper waste and reduced production time.

When a lithographic printing plate has become contaminated, such contaminated areas are rendered oil sensitive and result in background stains. The appearance of fingerprints in the background of prints is also ascribed to this condition. In addition, when the non-image areas take scratches, the scratches are filled with ink and are rendered oil sensitive and cause stains. In these cases, it is usual that the printing ink is first removed from the plate and then the stained areas are treated with a plate cleaner to restore the hydrophilic property of the non-image areas. Cleansing agents usually consist of dispersions and contain a number of heterogeneous substances such as those described in U.S. Pat. No. 2,780,168. Various other plate cleaning compositions are known as taught by U.S. Pat. Nos. 3,108,535; 3,289,577; 3,060,848; 4,162,920; 2,780,186; 3,679,479; and 3,489,561. In general, when stains are generated during the printing process, the surface is first treated with a hydrocarbon solvent to remove the ink and then with a desensitizing agent. This means in many cases that two steps are required.

Compositions for finishing, cleaning and preserving lithographic printing plates are well known in the art as exemplified by U.S. Pat. No. 4,162,920. Such are generally composed of an emulsion of an aqueous phase and a solvent phase. Principally the solvent phase dissolves the greasy inks built up on the plate, and the aqueous phase deposits on the image and non-image areas to protect them from atmospheric attack and to restore hydrophilicity to the background areas. It is important to produce an emulsion that is stable, i.e. the aqueous and solvent phases do not readily separate out. In this regard it is known to use gum arabic and dextrins, such as tapioca dextrin in the aqueous phase. Dextrins are obtained through either acid or alkaline hydrolysis of starches. Such dextrins are typically HCl hydrolyzed tapioca starches. It has now been unexpectedly found that when a finisher, preserver, cleaner emulsion is formulated with a maltodextrin prepared by enzyme hydrolysis of corn or potato starch, that emulsion stability is increased dramatically.

SUMMARY OF THE INVENTION

The invention provides a composition for finishing, preserving and cleaning lithographic printing plates consisting essentially of a stable emulsion of:

(a) from about 0.1% to about 7.0% by weight of the composition of a polyol selected from the group consisting of ethylene glycol, propylene glycol, sorbitol and glycerin having a molecular weight in the range of from about 50 to about 2,000; and (b) from about 1.0% to about 12.0% by weight of the composition of a maltodextrin obtained by the enzyme hydrolysis of corn or potato starch, said maltodextrin having a viscosity of from about 6,000 to about 9,000 cps when measured as a 25% solution in deionized water at 22° C.; and (c) from about 0.1% to about 3.0% by weight of the composition of a mixture of a $C_{18}$ to $C_{30}$ alcohol and an aminated, aliphatic $C_8$ to $C_{24}$ alcohol sulfate wherein the ratio of alcohol to sulfate ranges from about 1:1 to about 5:1; and (d) from about 5.0% to about 20.0% by weight of the composition of a composition of hydrocarbons having a boiling point in the range of from about 175° F. to about 500° F., and a flash point of above about 100° F., said composition of hydrocarbons containing less than about 10% aromatic components; and (e) from about 0.1% to about 3.0% by weight of the composition of a substituted phenoxypoly(oxyethylene)ethanol wherein the substitution is H, isooctyl, nonyl, decy or dodecyl, having a hydrophile/lipophile balance of from about 8 to about 15; and (f) from about 0.05% to about 1.0% by weight of the composition of a mono-, di- or tri- ethanolamine; and (g) sufficient water to formulate an effective finishing, preserving and cleaning composition for lithographic printing plates; and (h) a sufficient amount of an organic or inorganic acid to impart a pH to the composition of from about 2.5 to about 6.5.

In the preferred embodiment the inventive composition also contains a sufficient amount of a buffer compound, which is an ammonium, alkali metal or alkaline earth metal salt of an organic or inorganic acid, effective to maintain the pH of the composition in the range of from about 2.5 to about 6.5, and further comprising a bacteriostat or fungistat compound.

DETAILED DESCRIPTION OF THE PREFERRED EMBODIMENT

In the practice of the present invention, a composition is prepared which is broadly composed of a polyol; a maltodextrin; a mixture of a $C_{18}$ to $C_{30}$ alcohol and an aminated, aliphatic $C_8$ to $C_{24}$ alcohol sulfate; a composition of hydrocarbons preferably containing 100% aliphatic components; a substituted phenoxypoly(oxyethylene)ethanol; a mono-, di- or triethanolamine; and water; an acid to impart a pH to the composition of from about 2.5 to about 6.5; a buffer to maintain the pH, and preferably a bacteriostat/fungistat component.

The polyol component is preferably an ethylene glycol, sorbitol, propylene glycol or glycerin having a molecular weight in the range of from about 50 to about 3,000. It is preferably present in an amount of from about 0.1% to about 7.0% by weight of the composition. A more preferred range is from about 0.3% to about 4 0% and most preferably from about 0.5% to about 1.5%.

The composition then contains a maltodextrin component. The maltodextrin is obtained by the enzyme hydrolysis of corn or potato starch. The maltodextrin has a viscosity of from about 6,000 to about 9,000 cps when measured as a 25% solution in deionized water at 22° C. It has been found that this component dramatically improves the emulsion stability of the overall composition. For example, when the formulation of this invention is prepared with a HCl hydrolyzed tapioca dextrin instead of the maltodextrin, and accelerated shelf life testing is performed, the emulsion separates into phases after about 3 hours at 80° C. This temperature is selected to extrapolate to typical storage conditions in a timely fashion without destroying the properties of the composition. In contrast the same emulsion formulated with, for example enzyme hydrolyzed corn starch, separates into two phases after 35–40 hours at 80° C. This component is preferably present in the overall composition in an amount of from about 1.0% to about 12.0%, more preferably from about 2.5% to about 8.0% and most preferably from about 4.0% to about 7.0%. The most preferred component is STAR-DRI 20, available commercially from Staley Industrial Products of Decatur, Ill.

The composition then contains a mixture of a $C_{18}$ to $C_{30}$ alcohol and an aminated, aliphatic $C_8$ to $C_{24}$ alcohol sulfate wherein the ratio of alcohol to sulfate ranges from about 1:1 to about 5:1 and most preferably 3:2. The most preferred components are oleyl alcohol and aminated oleyl alcohol sulfate. It is preferably present in an amount of from about 0.1% to about 3.0% by weight of the composition, more preferably from about o.5% to about 1.5% and most preferably from about 0.75% to about 1.25%. This component is available commercially as Duponal OS.

The composition contains a composition of hydrocarbons having a boiling point in the range of from about 175° F. to about 500° F., and a flash point of above about 100° F. This composition of hydrocarbons contains less than about 10% aromatic components and preferably 100% aliphatic components. It is present in an amount of from about 5.0% to about 20.0% by weight of the composition, preferably from about 8.0% to about 16.0% and most preferably from about 10.0% to about 12.0%. Suitable components include Isopar G, H, K, L, and M, as well as Norpar 12 and 13, all available from Exxon. Isopar L is most preferred.

The composition contains a certain non-ionic surfactant which is a substituted phenoxypoly(oxyethylene)ethanol wherein the substitution is H, isooctyl, nonyl, decy or dodecyl, having a hydrophile/lipophile balance of from about 8 to about 15. It is preferably present in an amount of from about 0.1% to about 3.0% by weight of the composition, more preferably from about 0.5% to about 1.5% and most preferably from about 0.75% to about 1.25%. Suitable surfactants include Igepal CA-520, CA-620, CA-630, CA-720 and RC-520 available from GAF and Triton X-100 from Rohm & Haas. The most preferred compound is Igepal RC-520 with an HLB of 13.5.

The composition then contains from about 0.05% to about 1.0% by weight of the composition of a mono-, di- or tri-ethanolamine. Triethanolamine is most preferred. It is more preferably present in an amount of from about 0.15 to about 0.75% by weight of the composition.

The composition then contains sufficient water as the balance to formulate an effective finishing, preserving and cleaning composition for lithographic printing plates. Soft water or deionized water are most preferred. The composition also contains a sufficient amount of an organic or inorganic acid to impart a pH to the composition of from about 2.5 to about 6.5. Such acids non-exclusively include citric, phosphoric, ascorbic, sorbic, tartaric, phthalic, boric and sulfuric acids. A more preferred pH range is from about 4 to about 5 and about 4.5 being the most preferred case.

The composition then contains an optional salt buffer. Such nonexclusively include an ammonium, alkali metal or alkaline earth metal salt of an organic or inorganic acid, such as one of the above acids, in an amount effective to maintain the pH of the composition in the desired range. The buffer, when one is use is usually present in an amount of from about 0.5% or more based on the weight of the composition. A usual range would extend from about 0.5% to about 5.0%. Although additional amounts apparently are not detrimental, excess would not be economical.

The composition also may contain an optional bacteriostat/fungistat. The most preferred compound is acetoxydimethoxydioxane. It is preferably present in an amount of from about 0.001% to about 1.0% by weight of the composition, more preferably from about 0.01% to about 0.5% and more preferably from about 0.05% to about 0.1%. The most preferred compound is Givgard DXN.

The following non-limiting examples serve to illustrate the invention.

EXAMPLE 1

A composition for finishing, preserving and cleaning lithographic printing plates is prepared by forming an emulsion by mixing the following components:

| Component | Weight Percent |
|---|---|
| Carbowax 200 (polyethylene glycol) with mw approx. 200, from Union Carbide) | 1.250 |
| Givgard DXN | 0.100 |
| monosodium phosphate | 2.490 |
| Star-Dri 20 (Staley Industrial Products) | 5.520 |
| phosphoric acid | 0.005 |
| Duponol OS | 0.750 |
| Isopar L | 11.000 |
| Igepal RC-520 | 0.700 |
| triethanolamine | 0.300 |
| tap water | balance |
| | 100.000 |

This composition is subjected to accelerated shelf life testing by maintaining it at 80° C. and noting the length of time until phase separation. Phase separation is not noticed after 35 hours.

EXAMPLE 2

(Comparative) Example 1 is repeated except tapioca dextrin is substituted for the Star-Dri 20. This composition is subjected to accelerated shelf life testing by maintaining it at 80° C. and noting the length of time until phase separation. Phase separation is noticed after approximately 3 hours.

EXAMPLE 3

(Comparative) A composition for finishing, preserving and cleaning lithographic printing plates is prepared by forming an emulsion by mixing the following components:

| Component | Weight Percent |
|---|---|
| Givgard DXN | 0.096 |
| monosodium phosphate | 4.780 |

-continued

| Component | Weight Percent |
|---|---|
| tapioca dextrin | 7.648 |
| phosphoric acid | 0.005 |
| Duponol OS | 1.052 |
| Amsco 46 (hydrocarbon composition, 34% aromatic balance olefins and paraffins) | 8.604 |
| Trycol DA-4 (non-ionic surfactant HLB 10) | 0.382 |
| glycerin | 0.956 |
| tap water | balance |
| | 100.000 |

This composition is subjected to accelerated shelf life testing by maintaining it at 80° C. and noting the length of time until phase separation. Phase separation is noted after 10 minutes.

What is claimed is:

1. A composition for finishing, preserving and cleaning lithographic printing plates consisting essentially of a stable emulsion of:

(a) from about 0.1% to about 7.0% by weight of the composition of a polyol selected from the group consisting of ethylene glycol, propylene glycol, sorbitol and glycerin having a molecular weight in the range of from about 50 to about 2,000; and (b) from about 1.0% to about 12.0% by weight of the composition of a maltodextrin obtained by the enzyme hydrolysis of corn or potato starch, said maltodextrin having a viscosity of from about 6,000 to about 9,000 cps when measured as a 25% solution in deionized water at 22° C.; and (c) from about 0.1% to about 3.0% by weight of the composition of a mixture of a $C_{18}$ to $C_{30}$ alcohol and an aminated, aliphatic $C_8$ to $C_{24}$ alcohol sulfate wherein the ratio of alcohol to sulfate ranges from about 1:1 to about 5:1; and (d) from about 5.0% to about 20.0% by weight of the composition of a composition of hydrocarbons having a boiling point in the range of from about 175° F. to about 500° F., and a flash point of above about 100° F., said composition of hydrocarbons containing less than about 10% aromatic components; and (e) from about 0.1% to about 3.0% by weight of the composition of a substituted phenoxypoly(oxyethylene)ethanol wherein the substitution is H, isooctyl, nonyl, decy or dodecyl, having a hydrophile/lipophile balance of from about 8 to about 15; and (f) from about 0.05% to about 1.0% by weight of the composition of a mono-, di- or tri-ethanolamine; and (g) sufficient water to formulate an effective finishing, preserving and cleaning composition for lithographic printing plates; and (h) a sufficient amount of an organic or inorganic acid to impart a pH to the composition of from about 2.5 to about 6.5.

2. The composition of claim 1 wherein said compound (a) comprises a polyethylene glycol having an average molecular weight of about 200.

3. The composition of claim 1 wherein said compound (b) comprises a maltodextrin obtained by the enzyme hydrolysis of corn starch.

4. The composition of claim 1 wherein said compound (b) comprises a maltodextrin obtained by the enzyme hydrolysis of potato starch.

5. The composition of claim 1 wherein said compound (c) comprises a mixture of oleyl alcohol and aminated oleyl alcohol sulfate.

6. The composition of claim 1 wherein said compound (d) comprises a mixture of naphthenes and paraffins having substantially 100% aliphatic components.

7. The composition of claim 1 wherein said compound (f) is triethanolamine.

8. The composition of claim 1 wherein said compound (h) is an acid selected from the group consisting of citric, phosphoric, ascorbic, sorbic, tartaric, phthalic, boric and sulfuric acids.

9. The composition of claim 1 further comprising a sufficient amount of a buffer compound, selected from a group consisting of an ammonium, alkali metal or alkaline earth metal salt of an organic or inorganic acid, effective to maintain the pH of the composition in the range of from about 2.5 to about 6.5.

10. The composition of claim 9 wherein said buffer is present in an amount of at least about 0.5% by weight of the composition.

11. The composition of claim 9 wherein said buffer is selected from the group consisting of an ammonium, alkali metal or alkaline earth metal salt of an acid selected from the group consisting of citric, phosphoric, ascorbic, sorbic, tartaric, phthalic, boric and sulfuric acids.

12. The composition of claim 11 wherein said buffer is present in an amount of at least about 0.5% by weight of the composition.

13. The composition of claim 1 further comprising a bacteriastat or fungistat compound.

14. The composition of claim 11 wherein said bacteriastat or fungistat is present in an amount of at from about 0.001% to about 1.0% by weight of the composition.

15. The composition of claim 13 wherein said bacteriostat or fungistat is acetoxy-dimethoxydioxane.

16. The composition of claim 15 wherein said bacteriastat or fungistat is present in an amount of at from about 0.001% to about 1.0% by weight of the composition.

17. The composition of claim 1 wherein said compound (a) comprises a polyethylene glycol having an average molecular weight of about 200; and wherein said compound (b) comprises a maltodextrin obtained by the enzyme hydrolysis of corn starch; and wherein said compound (c) comprises a mixture of oleyl alcohol and aminated oleyl alcohol sulfate; and wherein compound (d) comprises a mixture of naphthenes and paraffins having substantially 100% aliphatic components: and wherein said compound (f) is triethanolamine: and wherein compound (h) is an acid selected from the group consisting of citric, phosphoric, ascorbic, sorbic, tartaric, phthalic, boric and sulfuric acids; and said composition further comprises a sufficient amount of a buffer compound, selected from the group consisting of an ammonium, alkali metal or alkaline earth metal salt of an organic or inorganic acid selected from the group consisting of citric, phosphoric, ascorbic, sorbic, tartaric, phthalic, boric and sulfuric acids, effective to maintain the pH of the composition in the range of from about 2.5 to about 6.5; and wherein said composition further contains a bacteriastat or fungistat which is acetoxy-dimethoxydioxane.

18. The composition of claim 17 wherein said acid is phosphoric acid and said buffer is monosodium phosphate.

19. The composition of claim 18 wherein compound (a) is present in an amount of from about 0.3% to about 4.0% based on the weight of the composition; and wherein compound (b) is present in an amount of from about 2.5% to about 8.0% based on the weight of the composition; and wherein compound (c) is present in an amount of from about 0.5% to about 1.5% based on the weight of the composition; and wherein compound (d) is present in an amount of from about 8.0% to about 16.0% based on the weight of the composition; and wherein compound (e) is present in an amount of from about 0.5% to about 1.5% based on the weight of the composition; and wherein compound (f) is present in an amount of from about 0.15% to about 0.75% based on the weight of the composition; and wherein compound (h) is present in an amount sufficient to impart a pH to the composition of from about 4 to about 5; and wherein said bacteriostat or fungistat is present in an amount of from about 0.01% to about 0.5% based o the weight of the composition.

20. The composition of claim 18 wherein compound (a) is present in an amount of from about 0.5% to about 1.5% based on the weight of the composition; and wherein compound (b) is present in an amount of from about 4.0% to about 7.0% based on the weight of the composition; and wherein compound (c) is present in an amount of from about 0.75 % to about 1.25% based on the weight of the composition and wherein the ratio of alcohol to sulfate is about 3:2; and wherein compound (d) is present in an amount of from about 10.0% to about 12.0% based on the weight of the composition; and wherein compound (e) is present in an amount of from about 0.75% to about 1.25% based on the weight of the composition and the compound has a hydrophile/lipophile balance of about 13.5; and wherein compound (f) is present in an amount of from about 0.15% to about 0.75% based on the weight of the composition; and wherein component (g) is soft or deionized water; and wherein compound (h) is present in an amount sufficient to impart a pH to the composition of about 4.5; and wherein said bacteriostat or fungistat is present in an amount of from about 0.05% to about 0.1% based on the weight of the composition.

* * * * *